US006845884B2

(12) United States Patent
Chan et al.

(10) Patent No.: US 6,845,884 B2
(45) Date of Patent: Jan. 25, 2005

(54) MULTI-CHAMBERED, UNIFORM DISPENSING TUBE

(75) Inventors: John Geoffrey Chan, Beijing (CN); Li Li, Ganluyuan (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/796,316

(22) Filed: Mar. 9, 2004

(65) Prior Publication Data

US 2004/0173632 A1 Sep. 9, 2004

Related U.S. Application Data

(63) Continuation of application No. 10/342,916, filed on Jan. 15, 2003, now abandoned, which is a continuation of application No. PCT/US02/21794, filed on Jul. 11, 2002.

(60) Provisional application No. 60/304,670, filed on Jul. 11, 2001.

(51) Int. Cl.[7] ..... B65D 35/22

(52) U.S. Cl. ..... 222/94; 222/145.1; 222/145.5; 222/556

(58) Field of Search ..... 222/94, 107, 145.1, 222/145.5, 556

(56) References Cited

U.S. PATENT DOCUMENTS 5,244,120 A * 9/1993 O'Meara ..... 222/94
5,318,203 A * 6/1994 Iaia et al. ..... 222/94
5,954,231 A * 9/1999 Durliat et al. ..... 222/1

* cited by examiner

*Primary Examiner*—Kenneth Bomberg
(74) *Attorney, Agent, or Firm*—Betty J. Zea

(57) ABSTRACT

Disclosed is a multi-chambered tube for containing and dispensing a contents comprised of portions having differing rheology and viscosity characteristics, the tube comprising: (a) a body divided by at least one body divider into at least two body chambers, each body chamber housing a portion of the contents, the body being sealed at one end by a crimp seal and one end of each body divider being sealed within the crimp seal; (b) a shoulder comprised of a shoulder base and a shoulder nozzle, the shoulder base being attached to the body, the shoulder nozzle having a face provided with at least two apertures, at least one aperture in communication with each of the body chambers, and the other end of each body divider disposed within the shoulder and being sealed at the face of the shoulder nozzle; (c) a cap comprised of a cap body provided with a dispensing orifice and at least one cap divider that separates the cap body into at least two cap chambers, each cap chamber being in communication with one of the body chambers via at least one of the apertures in the face of the shoulder nozzle, and the shoulder nozzle being received within the cap body when the cap and the shoulder are assembled. Further disclosed is a cap and shoulder assembly for use with a multi-chambered tube body.

7 Claims, 7 Drawing Sheets

MULTI-CHAMBERED, UNIFORM DISPENSING TUBE

CROSS REFERENCE RELATED TO APPLICATIONS

This is a continuation of U.S. application Ser. No. 10/342,916 filed on Jan. 15, 2003 now abandoned which is a continuation of International Application PCT/US02/21794 with an international filing date of Jul. 11, 2002 which claims benefit of Provisional Application Ser. No. 60/304,670 filed Jul. 11, 2001.

FIELD

The present invention relates to a multi-chambered tube for uniform dispensing of a composition comprised of differing components contained in each of the chambers of the tube, and is particularly useful for dispensing multi-phased dentifrice compositions.

BACKGROUND

Multi-chambered tubes for the simultaneous delivery of different substances when the tube is squeezed have previously been known. Concentric type tubes, in which chambers of generally circular cross section and of approximately equal volume are provided one within the other, as well as side by side type tubes, in which the chambers are generally adjacent to each other, have been proposed. In either case, achieving a simultaneous dispensing of each component from the tubular container that is uniform, regardless of where and how the container is squeezed, remains problematic. Another continuing problem is providing an attractive presentation of a dispensed multi-component composition contained in such a tube.

The amount of material dispensed from each chamber of a multi-chambered tube is dependent upon the decrease in volume of the chamber occasioned by the deformation of the walls of the chamber. This deformation, and thus the amount of material dispensed, depends upon several factors including the relative rheologies and viscosities of the substances to be dispensed, the size and shape of the orifice(s) through which the substances are dispensed, the pressure applied to the tube, and the configuration of the tube and chambers. Concentric chambered tubes are generally believed to be less desirable as compared to side by side chambered tubes due to the increased skin friction seen by the composition in the outer chamber of a concentric tube that results from increased contact with the outer wall of the inner chamber.

U.S. Pat. No. 5,927,550, "Dual Chamber Tubular Container," issued to Mack et al. on Jul. 27, 1999 discloses a side by side tubular container having a dividing wall that is attached longitudinally to the tubular chamber sidewalls. The plane of the divider wall of the dispensing exit is offset from the plane of the crimp seal at the bottom of the tube preferably by about 90°. Other previously described tubular containers include those in which the crimp seal and the exit divider wall are in the same plane, e.g., U.S. Pat. Nos. 1,894,115 and 3,788,520; and German patent No. 2017292.

However, the tubular container described in the above-mentioned Mack et al. US patent is believed to be difficult to manufacture in terms of attaching the dividing wall to the tubular chamber sidewalls, and further in terms of connecting the dividing wall of the tube to the injected molded dividing wall of the tube shoulder. Thus, this tube is not believed to be easy or cost-effective to manufacture.

U.S. Pat. No. 5,954,234, "Uniform Dispensing Multi-chamber Tubular Containers," WO 97/46462, "Codispensing of Physically Segregated Dentifrices at Consistent Ratios," and WO 97/46463, "Uniform Dispensing Multi-chamber Tubular Containers," each describe a multichamber container in which the outer walls and inner divider walls have specified physical characteristics. The inner partition wall of this tube shifts laterally to respond to compressive displacement of the outer walls of the tube during squeezing. This partition wall is therefore made as thin and flexible as possible.

It is believed that uniformity of dispensing from this tube is less than ideal because the inner divider wall is thin and soft, thus making it difficult to build required pressure in the chambers to maintain even dispensing of a product, especially if the component compositions of the product are of greatly different relative rheologies and viscosities. Further, this tube has no device for flow regulation, making it difficult to maintain an even volume change across the chambers upon dispensing.

Based on the foregoing, there is a continued need for a multi-chambered dispensing tube that can consistently deliver the same amount, shape, and size of the component compositions contained in each chamber at the same dispensing rate, regardless of how the tube is squeezed. There is also a need for such a tube to be cost effective and easy to manufacture. None of the existing art provides all of the advantages and benefits of the present invention.

SUMMARY

The present invention is directed to a multi-chambered tube for containing and dispensing a contents comprised of portions having differing rheology and viscosity characteristics, the tube comprising: (a) a body divided by at least one body divider into at least two body chambers, each body chamber housing a portion of the contents, the body being sealed at one end by a crimp seal and one end of each body divider being sealed within the crimp seal; (b) a shoulder comprised of a shoulder base and a shoulder nozzle, the shoulder base being attached to the body, the shoulder nozzle having a face provided with at least two apertures, at least one aperture in communication with each of the body chambers, and the other end of each body divider disposed within the shoulder and being sealed at the face of the shoulder nozzle; (c) a cap comprised of a cap body provided with a dispensing orifice and at least one cap divider that separates the cap body into at least two cap chambers, each cap chamber being in communication with one of the body chambers via at least one of the apertures in the face of the shoulder nozzle, and the shoulder nozzle being received within the cap body when the cap and the shoulder are assembled.

The present invention is further directed to a cap and shoulder assembly for use with a multi-chambered tube body.

These and other features, aspects, and advantages of the invention will become evident to those skilled in the art from a reading of the present disclosure.

BRIEF DESCRIPTION OF THE DRAWINGS

While the specification concludes with claims particularly pointing out and distinctly claiming the invention, it is believed that the present invention will be better understood from the following description of preferred embodiments taken in conjunction with the accompanying drawings, in which like reference numerals identify identical elements and wherein:

DETAILED DESCRIPTION

Although the following detailed description is given primarily in the context of a tube for containing a dual-phased dentifrice product, it will be understood that the tube may be useful for containing and dispensing other products where it is desirable to contain different compositions or different components of a composition in separate chambers of the tube, where mixing of the compositions or components occurs only at the time of dispensing. For example, such compositions or components include oral care compositions such as dual-phased dentifrices, food products, hair care products, cosmetic products, and the like. In addition, the use of the term "dentifrice" herein should be understood to non-limitingly include oral care compositions such as toothpastes, gels, and combinations of such pastes and gels.

In addition, while the description herein is mainly given in the context of a body having two chambers, it is understood that the body and cap of the present invention may be divided into multiple chambers, each chamber housing a component portion of a composition. Such embodiments are within the scope of the present invention.

Figure 1:
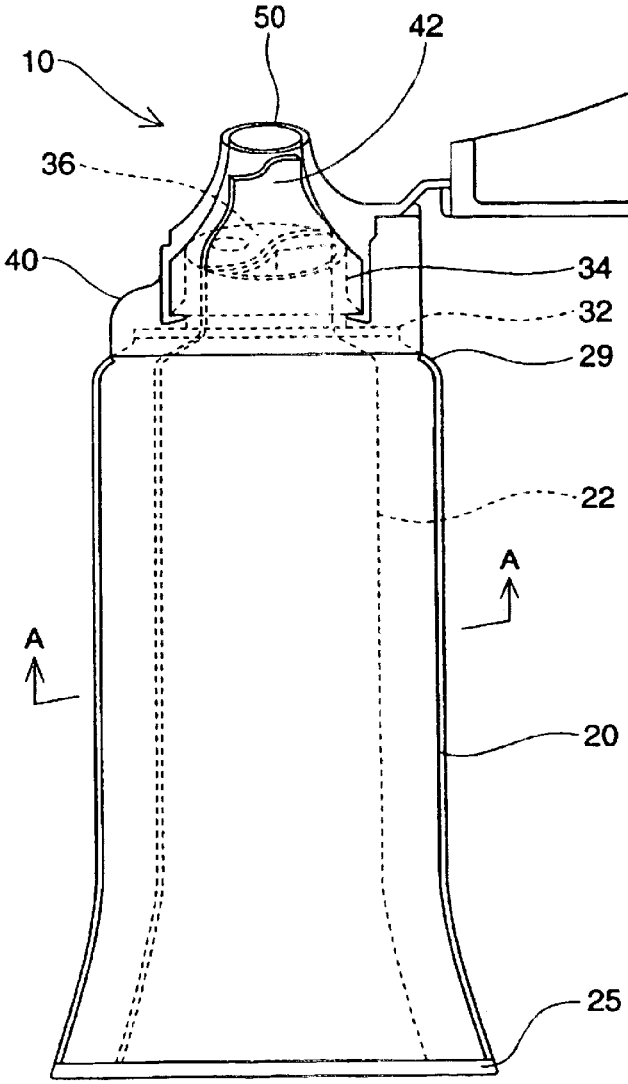
FIG. 1 is a side view of a preferred embodiment of the tube assembly of the present invention, comprising a body, a shoulder and a cap, with the interior of the assembly shown in perspective in dashed lines.

Referring to FIG. 1, a preferred embodiment of a multi-chambered tube 10 of the present invention is shown. The tube 10 is generally comprised of a tube body 20 having an interior body divider 22, a shoulder 30 (see FIG. 2) and a cap 40 (see FIG. 3) that is provided with a dispensing orifice 50 through which a desired amount of the contents of the tube can dispensed when the tube body is squeezed by the user. The cap 40 is preferably provided with a flip open lid 60 that is hinged to the cap body 44. Alternatively, a screw-on type cap (not shown in the Figures) could be provided.

In the FIG. 1 embodiment, a dual chambered tube 10 is shown. The body 20 is divided into two side by side chambers by the body divider 22. A first body chamber 18 houses a first portion of a contents and a second body chamber 19 houses a second portion of the contents. Such a tube is useful, for example, in housing a dual phased dentifrice composition in which the first portion of the contents comprises ingredients that are reactive with ingredients contained in the second portion of the contents. A non-limiting example is a dentifrice formulation in which the first portion comprises a soluble fluoride ion source and the second portion comprises a polyphosphate source such as linear "glassy" polyphosphates. Such polyphosphates significantly react with ionic fluoride in oral compositions at ambient temperature; this reaction compromises the ability of the oral composition to provide stable ionic fluoride and polyphosphate to the oral surfaces. Thus, the two component compositions must remain physically separated until the time of actual use. Such a dentifrice is described in, e.g., WO98/22079, "Dentifrice Compositions Containing Polyphosphate and Fluoride," published May 28, 1998.

Figure 1A:
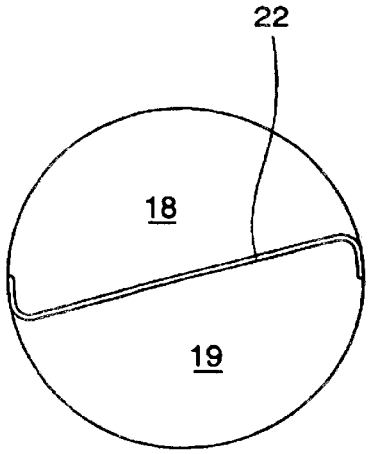
FIG. 1*a* is a cross sectional view taken along the line A—A in FIG. 1.
Figure 1B:
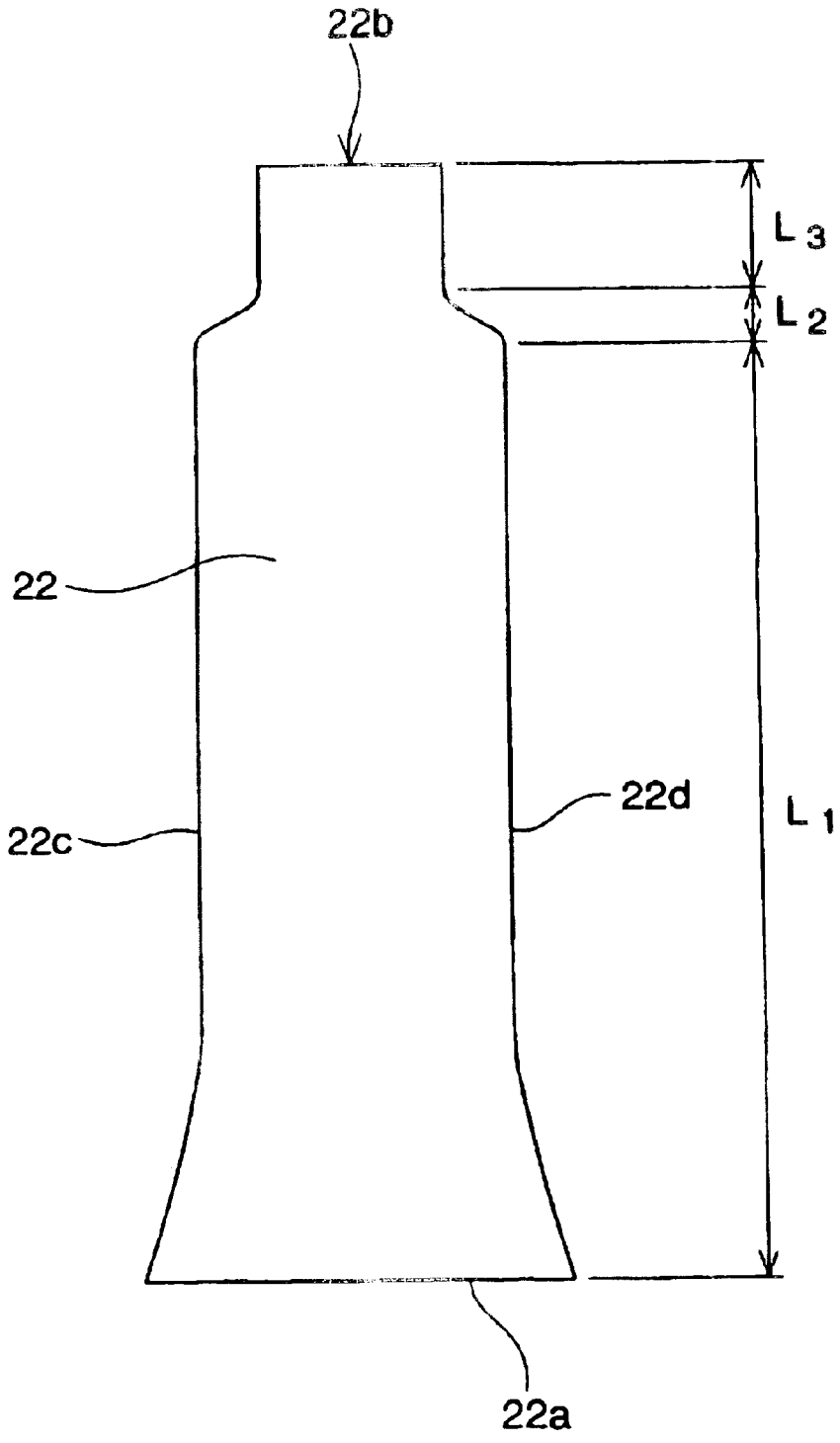
FIG. 1*b* is a plan view of the divider wall 22 that is shown in FIG. 1.

The body divider 22 and the chambers 18 and 19 can easily be seen in FIG. 1*a*, which shows a sectional view of the body taken along the line A—A in FIG. 1. The body 20 is sealed by a crimp seal 25 at the end of the tube that is opposite from the dispensing orifice 50. Referring to FIG. 1*b*, a plan view of the body divider 22 is shown. One end (crimp seal end) 22*a* of the body divider 22 is sealed within the crimp seal 25. The body divider 22 extends from the crimp seal 25 inside the body 20 and inside the shoulder 30. The other end (shoulder end) 22*b* of the body divider 22 is sealed within the shoulder 30, more specifically, to the interior surface of the shoulder nozzle 34. More specifically, the shoulder end 22*b* is sealed at the face 36 of the shoulder nozzle. The longitudinal edges 22*c* and 22*d* of the body divider 22 are sealed along the interior surfaces of the body 20 and the shoulder 30. These portions of the longitudinal edges 22*c*, 22*d* are generally indicated as L1 on FIG. 1*b*. The portions generally indicated as L2 are sealed to the shoulder base 32, and the portions generally indicated as L3 are sealed to the shoulder nozzle 34.

Accordingly, different components of a composition such as a dual phased dentifrice composition can be placed into each of the chambers 18 and 19, and can be kept physically separate until the time of actual use. Each component will have different viscosity and rheology characteristics and therefore different flow characteristics when a compressive (squeezing) force is applied to the tube by a user; hence, the source of the difficulties in uniform dispensing.

To compensate for differences in flow in response to the compressive force applied, the component portions of the composition housed in the container may be formulated so that the compressive force required to cause each component to flow is substantially equivalent, as described in WO 97/46462. However, the types of formulations that may be housed in such as container as well as the formulator's selection of ingredients are quite limited.

It is believed that compositions in which the components have significantly different yield stresses and shear indicies are especially difficult to dispense. Yield stress and shear index are relevant to viscosity according to the Hershcel-Bulkley viscosity model in which:

$$\text{Viscosity}=(\text{yield stress/shear rate})+(\text{consistency factor}\times(\text{shear rate})^{(n-1)}).$$

According to the present invention, there is no need to formulate the composition housed in the container such that the compressive forces required to cause each component to flow are substantially equivalent. The container of the present invention, and in particular the cap and shoulder assembly of the present invention, provides regulation of the respective flow speeds of the components to provide uniform dispensing. Thus, a wide range of formulations and ingredients may be used in connection with the container of the present invention without limitation.

Referring to FIG. 1*a*, a cross section of the body taken at a point that is about halfway between the crimp seal 25 and the dispensing orifice 50, e.g., at section line A—A in FIG. 1, can be seen. The two chambers 18 and 19 divided by the body divider 22 are shown. Preferably, the body divider 22 experiences no spiraling from the crimp seal 25 through the interior of the body 20 and into the shoulder 30. In other words, it is not necessary that the body divider 22 be curved or have a sinusoidally shaped curve that matches the curvature of the cap divider 42; the body divider 22 preferably does not "turn" within the body of the tube. Its function is to separate the body into two chambers and to contribute to uniform dispensing as further described below.

Accordingly, "turning" of the two component streams just prior to dispensing Occurs only in the cap 40, as a result of the arrangement of the cap divider 42. It is believed to be difficult to attach a curved or sinusoidally shaped body divider (such as that described in the previously-referenced Mack et al. U.S. Pat. No. 5,927,550) into a tube body. It is further believed that matching such curvature with a curved tube divider is very difficult during manufacture. In addition, it is believed that the actual filling with product of a tube having such a curved or sinusoidally shaped tube divider is very difficult and less efficient than filling a tube according to the present invention.

Therefore, the tube of the present invention is believed to provide manufacturing advantages over the previously developed side by side and concentric dual chambered tubes. The tube 10 comprised of a body 20 and a body divider 22 according to the preferred embodiments herein may be assembled using conventional tube manufacturing processes that are simple and cost-effective. The divider 22 is simply inserted into the body 20 and sealed along the edges as follows. The web from which the tube body 20 is formed is rolled up and formed into a generally rounded or oval shape. The divider 22 is inserted into the pre-finished rounded-shaped body; then the divider 22 is longitudinally sealed along the tube edges after the divider 22 has been correctly positioned within the body, see FIGS. 1 and 1*a*.

Then, the tube body 20 with the divider 22 sealed within it are simultaneously attached with the tube shoulder 30 in one step as follows. A piece of hot donut shaped HDPE material is spitted into a tube shoulder mold, and then the rounded-shaped tube body with the divider fixed therein is compressed into the hot donut shaped HDPE to form the tube shoulder.

This process of body and shoulder assembly has been used widely. For example, such a process for the assembly of a tube body and shoulder is disclosed in Canadian patent application no. 2,229,879, "Process for the Production of a Multi-Chamber Packaging Tube," published to F. Scheifele on Mar. 24, 1998. As indicated above, this known assembly process can readily be adapted to manufacturing the tubes of the present invention by adding the step of longitudinal sealing of the body divider to the pre-finished tube body. It is also easy to fill the tubes according to the present invention due to the rigidity of the body divider and the wider filling space.

Figure 1C:
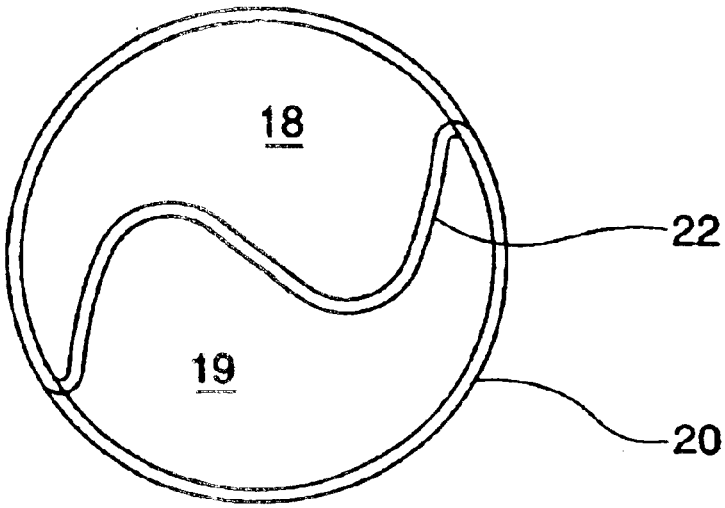
FIG. 1*c* is a cross sectional view of another preferred embodiment of the present invention taken along the line A—A in FIG. 1.

Alternatively, the tube body and divider wall can be assembled as follows. The body divider is first sealed to the web that comprises the sidewall of the tube body, before this web is rolled into the pre-finished tubular shape. After the web has been rolled up and formed into the tubular shape, the body divider is then blown up so that it creates two side by side chambers. In such an embodiment, the body divider is usually made from a less rigid material as compared to the material that forms the tube body, so that the body divider can be blown up to create the chambers. A cross section of such a tube is shown in FIG. 1*c*. However, it is believed that this type of tube is overall more difficult to manufacture and fill than the preferred embodiment with rigid body divider wall described above. Another potential disadvantage of such a design is that the body divider tends to contact and follow the shape of the tube body sidewall instead of maintaining the separation between the two chambers.

Figure 1D:
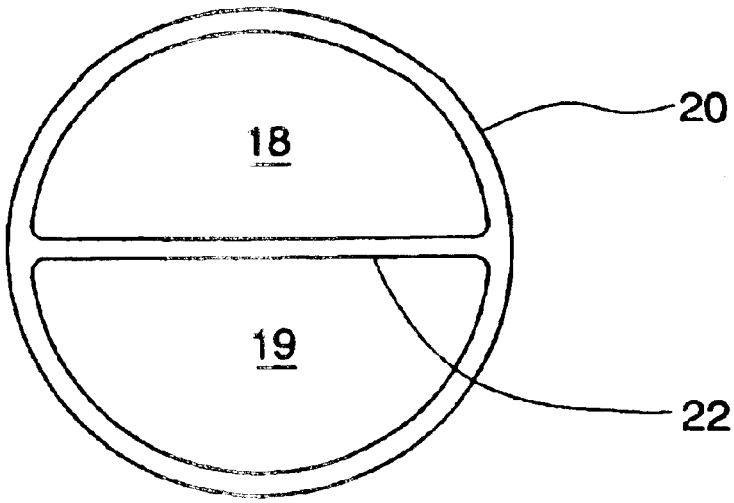
FIG. 1*d* is a cross sectional view of yet another preferred embodiment of the present invention taken along the line A—A in FIG. 1.

In another alternative configuration of the tube body, the body is comprised of two separate chambers, a first chamber 18 in the shape of a "D" and a second chamber 19 being a mirror image of the first chamber 18. A cross section of such a tube body is shown in FIG. 1*d*. In such an embodiment, the divider wall is not a separate element as in the preferred embodiment shown in FIGS. 1, 1*a*, and 1*b*.

The tube body 20 and the body divider 22 may be comprised of any materials known to those of skill in the art that provide adequate storage of the dentifrice or other product contained in the tube. The materials comprising the body 20 should have no reaction with the components that comprise the contents, such that the contents could be rendered unsafe or otherwise unsuitable for consumer use. They should, of course, also be durable enough to withstand normal consumer use without leakage, tearing or breakage, etc.

For containing a dentifrice product, non-limiting examples of suitable materials from which the tube body may be comprised include polyethylenes, such as low density polyethylene ("LDPE"), linear low density polyethylene ("LLDPE"), medial density polyethylene ("MDPE"), and high density polyethylene ("HDPE"), ethylene acrylic acid ("EAA"), foils, such as aluminum foil, or any of the above materials in any combination, for example, formed as a laminate structure. The side walls of the tube body 20 are preferably from about 0.1 mm to about 0.4 mm thick, with about 0.3 mm generally being suitable. It is possible to provide thicker or thinner sidewalls, but it is believed that such would not be particularly cost-effective and would not necessarily provide additional dispensing benefits. Laminate materials are preferred for the body side walls.

The body divider is preferably from about 0.05 mm to about 0.30 mm thick, preferably from about 0.1 mm to about 0.25 mm thick. Preferably the body divider 22 is made from a substantially rigid material so as to cooperate with the shoulder 30 and cap 40 to provide uniform dispensing of compositions comprised of components of widely varying relative viscosities and rheologies. "Rigid" as used herein means that the body divider 22 experiences minimal or negligible lateral shifting in response to any pressure differential existing in the tube interior. This is important to provide an even volume flow of each component from the body chambers 18, 19 and into the cap chambers 48, 49. The body divider 22 is not collapsible in either direction and is not displaced in either direction by a pressure differential across it. The body divider 22 is substantially non-displaceable in response to application of compressive force to the tube body. A preferred material for the divider wall is HDPE.

The tube body 20 is crimp sealed 25 at the end of the tube that is opposite the dispensing orifice 50. The other end of the tube body 20 is attached to the shoulder 30 in continuous bonded or sealed contact such that the contents of the tube are prevented from leaking out at the juncture 29. The cap 40 is assembled with the shoulder 30 as described in detail below such that the contents of the tube are similarly prevented from leaking.

Figure 4:
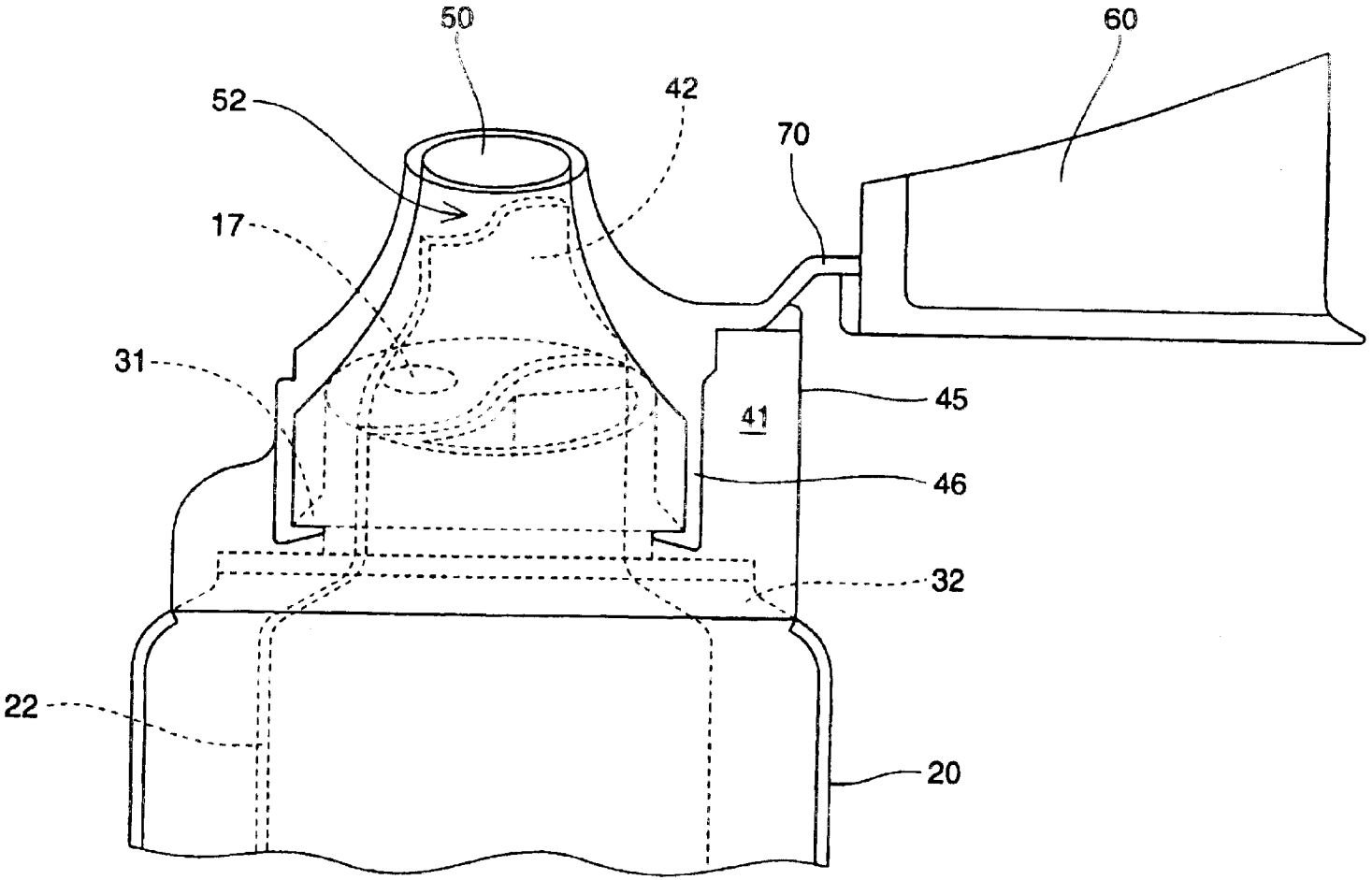
FIG. 4 is a portion of the preferred embodiment of the tube of FIG. 1, showing the assembly of the shoulder and the cap.

The cap 40 and the shoulder 30 are desirably made by, e.g., injection molding. As described more fully below, in a preferred embodiment they are preferably comprised of separate pieces that are securely fitted to each other. In addition, the cap 40 and the shoulder 30 preferably have different material compositions, but alternatively may be comprised of the same material. Non-limiting examples of suitable materials from which the shoulder and the cap may be comprised include the polyethylenes described above. The shoulder/cap assembly is shown in FIG. 4.

Although the embodiment of the tube body and divider wall that is shown in FIGS. 1, 1*a*, and 1*b* is preferred herein, it is possible to combine the shoulder and cap assembly of the present invention with alternative tube body/divider wall combinations, for example as shown in FIGS. 1*c* and 1*d* and as described above, and such other combinations are within the scope of the present invention.

Figure 2B:
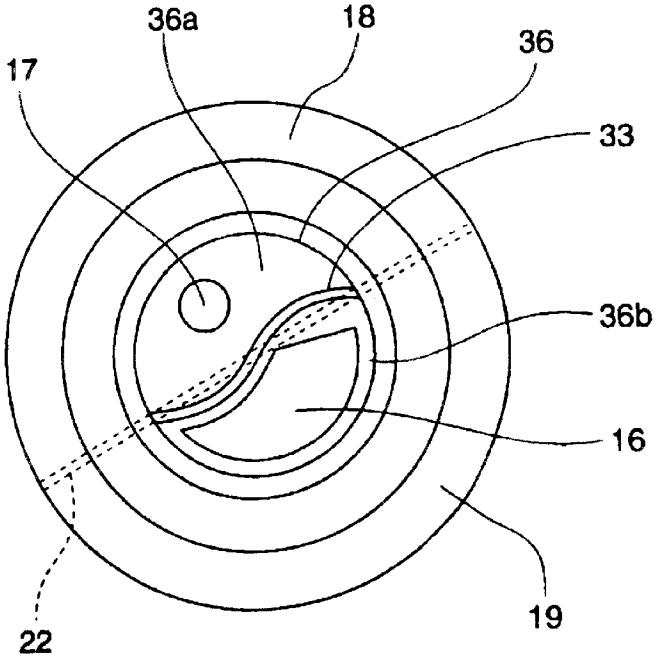
FIG. 2*b* is a top view of the portion of the tube shown in FIG. 2*a;*
Figure 2A:
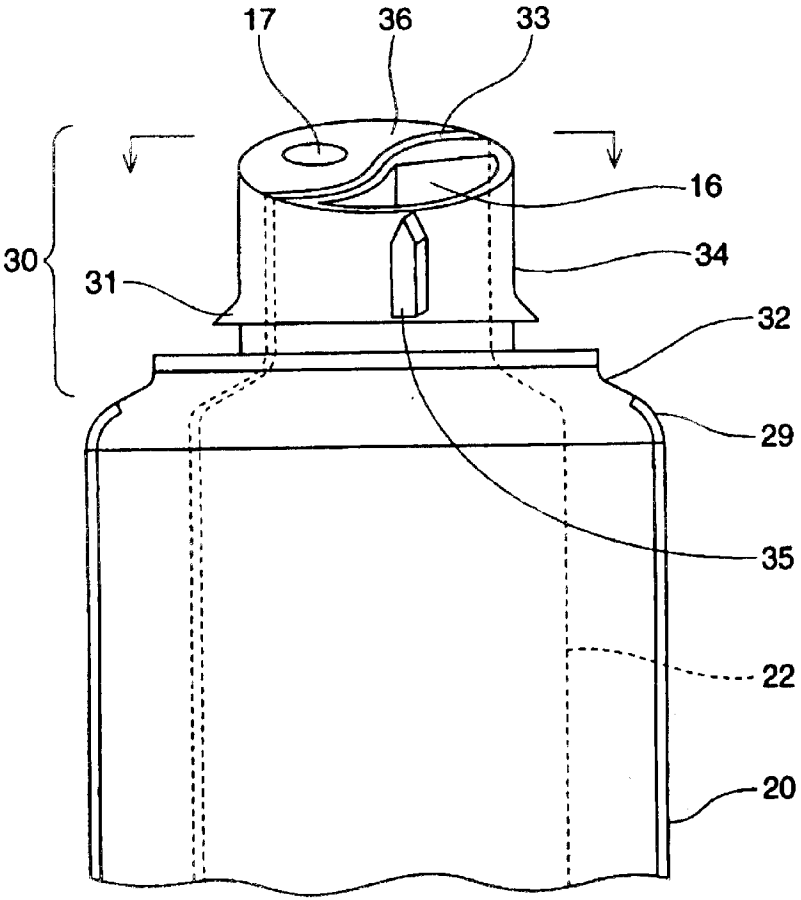
FIG. 2*a* is a perspective view of a portion of the tube of FIG. 1 with the cap removed.

Referring to FIG. 2*a*, a preferred embodiment of the shoulder 30 will now be described in greater detail. The shoulder 30 is generally comprised of a shoulder base 32 and a shoulder nozzle 34. The shoulder 30 is attached to the tube body 20 at the shoulder base 32 in a continuous bonded or sealed contact 29 such that the contents of the tube are prevented from leaking out at this juncture. The shoulder nozzle 34 extends from the shoulder base 32 upwardly away from the tube body 20 and is received within the cap 40 when the shoulder and the cap are assembled. When assembled, there should be no leakage of contents during dispensing.

The shoulder nozzle 34 and the shoulder base 32 are preferably continuously formed from a unitary piece of material (e.g., by injection molding) as shown in FIG. 2*a*; alternatively, they may be comprised of separate pieces fused or otherwise securely attached to each other by any means known to those of skill in the art. For example, the shoulder 36 can be an integrated part of the tube body via injection or compression molding, can be screwed onto the tube by the use of mated threads, or can be heat sealed or glued to secure the shoulder face 36 with apertures 16, 17 onto the tube shoulder.

In addition, the shoulder nozzle 34 and the shoulder base 32 preferably have the same material composition, but alternatively may be comprised of different material compositions. Non-limiting examples of suitable materials include the polyethylenes described above.

FIG. 2*b* is a top view of the tube and shoulder shown in FIG. 2*a* (with the cap removed). The face 36 of the shoulder nozzle 34 can clearly be seen in FIG. 2*b*. With reference to FIG. 2*b*, the shoulder face 36 is preferably separated into sections by a groove 33. Preferably, the shoulder face 36 is comprised of at least a first section 36*a* and a second section 36*b*. The shoulder face 36 will have as many sections as the tube has chambers. For example, in the preferred embodiment shown in the Figures, the tube 20 has two chambers 18 and 19; correspondingly, the shoulder face 36 has two sections, first section 36*a* and second section 36*b*. The shoulder face first section 36*a* and the shoulder face second section 36*b* can be an integrated one piece element or may be separate pieces.

The shoulder face 36 is provided with at least two apertures. At least one aperture 16 is in communication with the first body chamber 19; similarly, at least one aperture 17 is in communication with the second body chamber 18. In other words, at least one aperture is in communication with each body chamber to provide a flow path for the component housed in that body chamber.

Although only one aperture per chamber is shown in the Figures, it should be understood that the present invention is not limited to such a configuration. The number of apertures in each section of the shoulder face 36, as well as the characteristics of each aperture, e.g., shape and dimension of each individual aperture, is determined by matching the viscosity and rheology of the components contained in each of the chambers of the tube. This permits an even volume flow through the apertures in each chamber during squeezing. Thus, the contents housed in each chamber of the tube are dispensed simultaneously and at a uniform dispensing rate. Multiple apertures in communication with each chamber may be provided, and may be of any size and/or shape, as long as they are chosen to provide the appropriate respective flow rates.

As shown in FIGS. 2*b* and 4, the groove 33 is preferably shaped such that at least a portion of the cap divider 42 is fitted into the groove when the shoulder 30 and the cap 40 are assembled, see FIG. 4. When the shoulder 30 and the cap 40 are thus assembled, this groove 33 receives the lowermost end of the correspondingly shaped cap divider 42, see also FIG. 3*c*, to provide a secure fit without leakage between the cap 40 and the shoulder 30. While the groove 33 is shown in the Figures as having a waved or sinusoidal shape, it should be understand that other shapes are within the scope of the present invention. However, it is believed that the illustrated wave shape of the cap divider 42 is desirable in term of provided the dispensed composition with an aesthetically appealing appearance.

The aperture(s) 17 located in the first section 36*a* on one side of the groove 33 allow(s) the component contained in the first chamber 18 of the tube to pass through it to the toward dispensing orifice 50, via the cap 40. Similarly, the aperture(s) 16 located in the second section 36*b* on the other side of the groove 33 allow(s) the component contained in the second chamber 19 of the tube to pass through it to the toward dispensing orifice 50, via the cap 40.

The shoulder nozzle 34 may further be provided with one or more alignment protrusions 35 that are located around the outer circumference of the shoulder nozzle 34, see FIG. 2*a*. Although only one such protrusion 35 is shown in FIG. 2*a* for purposes of illustration, it should be understood that any number of such protrusions is within the scope of the present invention.

If the shoulder nozzle is provided with one or more of such protrusions 35, the interior of the cap body 44 will be provided with an equal number of slots on the inside surface of the fitting ring 46 (slots are not shown in the Figures). Thus, when the shoulder 30 and the cap 40 are assembled, the alignment protrusions 35 sit within the slots to contribute to the stability of the fit between the cap and the shoulder.

Figure 3A:
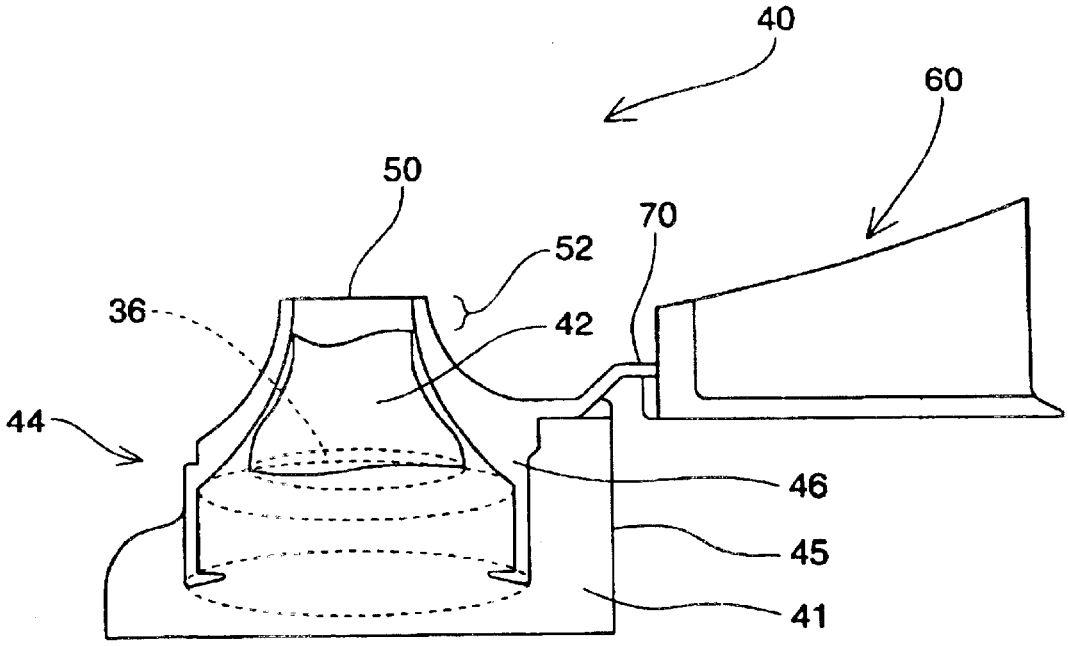
FIGS. 3*a*–3*c* are a side view, a top view, and a bottom view, respectively, of a preferred embodiment of the cap of the present invention, with the interior of the cap shown in dashed lines in FIG. 3*a*.
Figure 3B:
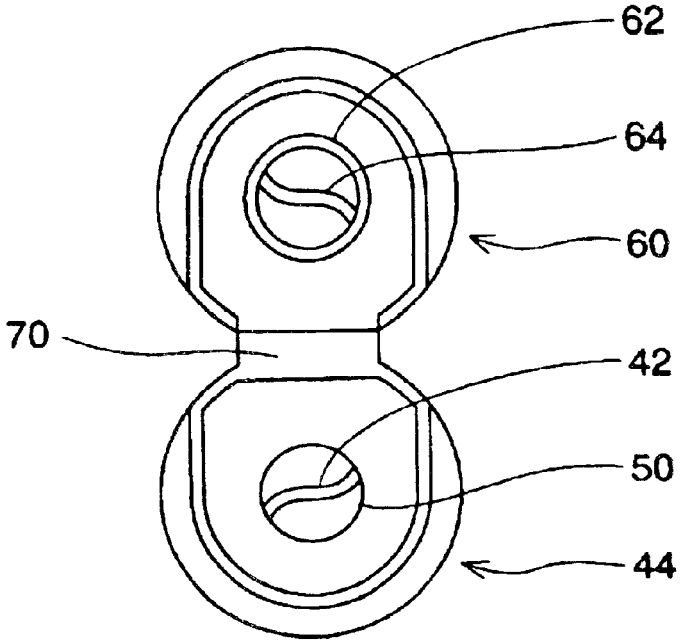

Referring to FIGS. 3*a*–3*b*, a preferred embodiment of the cap 40 of the present invention is shown. Referring to FIG. 3*a*, the cap 40 has a cap body 44 provided with dispensing orifice 50 and a cap divider 42. The cap divider 42 separates the cap body 40 into two chambers, a first cap chamber 48 and a second cap chamber 49. The cap divider 42 acts as a continuation of the tube body divider 22. The cap 40 may also be provided with a flip open lid 60 that is hingedly attached 70 to the cap body 44. However, other types of caps, e.g. screw on caps, can be provided and are within the scope of the present invention. While two cap chambers are shown in the Figures, it should be understood that the cap of the present invention may have more than two chambers. In general, at least one cap divider separates the cap body into as many cap chambers as there are tube body chambers. Each cap chamber is in communication with one of the body chambers via at least one of the apertures in the face of the shoulder nozzle, and the shoulder nozzle is received within the cap body when the cap and the shoulder are assembled.

The cap body 44 is securely fitted to the shoulder 30, and when the cap 40 and the shoulder 30 are so fitted, the cap body 44 receives the shoulder nozzle 34, tightly encircling it so that no leakage at this juncture occurs. This secure fit between the cap body 44 and the shoulder 30 may be provided for example via an integration of the molded parts 44 and 30, a threaded screw on fit, or by a heat seal or glue. Thus, the groove 33 and apertures 17 and 16 that are provided in the face 36 of the shoulder nozzle 34 are received within the cap body 44 when the cap 40 and the shoulder 30 are assembled. This assembly provides a continuous path for the component streams flowing from each body chamber 18, 19 into each of the cap chambers 48, 49, before the streams are mixed just prior to final dispensing out of the tube via the dispensing orifice 50.

The cap chambers 48, 49 of the present invention also serve as a damper to further regulate flow (volume/time) of the composition being dispensed. The cap chambers 48, 49 provide areas to rebuild volume before product exits the orifice 50.

Figure 3C:
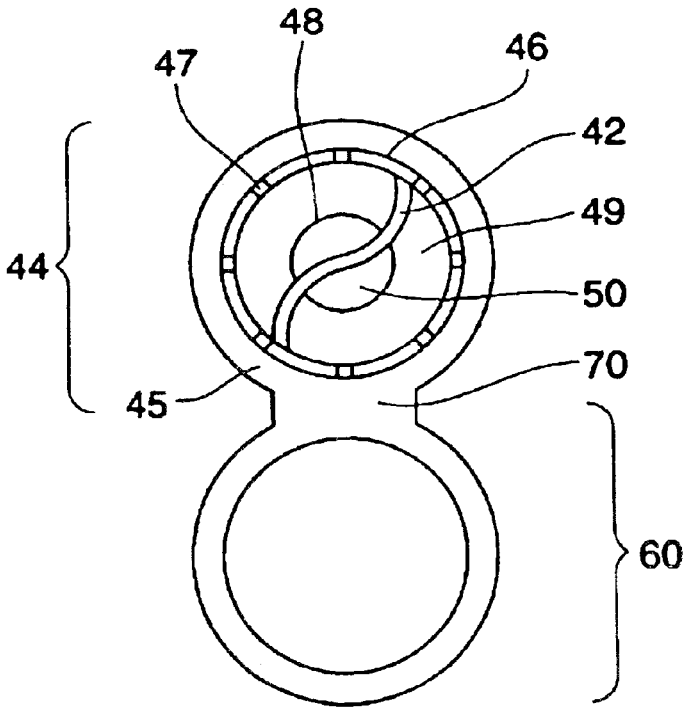

In FIG. 3*c*, showing a bottom view of a preferred embodiment of the cap 40 of the present invention, the cap divider 42 can be seen. In addition, the fitting ring 46 can be seen. The fitting ring 46 is to secure the cap 40 to the shoulder 30. The fitting ring 46 preferably has several notches 47 in its circumference. The notches 47 provide the fitting ring 46 with a certain amount of flexibility that assists in the securing of the cap 40 to the shoulder nozzle 34. In addition, the shoulder nozzle 34 may be preferably provided with an annularly projecting ring 31 (see especially FIGS. 2*b* and 4), over which the fitting ring 46 of the cap 40 can be fitted. When the cap 40 and the shoulder 30 are assembled, this fitting ring 46 securely surrounds and holds the shoulder nozzle 34.

The fitting ring 46 is concentrically disposed within an outer portion 45 of the cap body 44, see FIGS. 3*a* and 3*c*, and there exists a small gap 34 between the cap outer portion 45 and the fitting ring 46. When the cap 40 and the shoulder 30/body 20 are assembled, the cap outer portion 45 is contiguous with the tube body 20, providing a generally continuous appearance, see FIGS. 1 and 4. The shoulder 30 is not seen as part of the outward appearance of the assembled tube 10.

The cap divider 42 is preferably mated with the correspondingly shaped groove 33 in the face 36 of the shoulder nozzle 34 when the cap and the shoulder are assembled. At its other end, the cap divider 42 preferably extends to a location just below the plane of the nozzle opening orifice 50, i.e., slightly recessed from the plane of the orifice 50, preferably by about 1 mm to about 3 mm, see FIG. 3*a*. This recess 52 allows the component streams, e.g., the first portion of the contents housed in the first body chamber 18 and the second portion of the contents housed in the second body chamber 19, to merge just after clearing the uppermost end of the cap divider 42 and just before actually exiting the orifice 50. This merging is important for ensuring the appearance of even dispensing of the dual phased product from the tube. The component stream that is generally of higher comparative viscosity can help to "pull" the component stream that is of lesser comparative viscosity, avoiding separation of the two streams as they exit the orifice. Therefore, the dispensed composition comprised of two different component portions will have an attractive and uniform appearance upon dispensing.

As shown in FIG. 3*b* (a top view of the cap), the lid 60 may desirably be provided with a lid ring 62 that fits circumferentially around the dispensing orifice 50 when the lid is closed. Within the lid ring 62 it is further desirable to provide a lid projection 64 that is mated to the shape of the cap divider 42, such that the lid projection 64 is seated within the recess 52, in mated contact with the uppermost end of the cap divider 42, when the lid 60 is closed. This prevents drying of the composition after one use and before the next subsequent use.

Based on the present description, it can be seen that the cap 40/shoulder 30 assembly, in combination with the rigid body divider 22, provides uniform simultaneous dispensing. The tube body 20 with divider 22 need not have a complex design since the flow rate and dispensing characteristics are primarily dependent upon the design of the cap 40 and the shoulder 30. Accordingly, manufacture and filling of the tube as well as sealing of the divider wall to the tube body can be carried out using conventional tube manufacturing processes that need not be expensive. In addition, the tube of the present invention can be made in many different sizes, including small volume sizes such as less than 50 grams, which is believed to be difficult with the currently available dual chambered tube designs.

The tube of the components of the dual-phased composition are contained in the first and second body chambers, respectively. Upon squeezing of the tube, each component flows from its body chamber, through its respective aperture (s) in the face of the shoulder nozzle, into its respective cap chamber. During all this time, the components are maintained physically separate by the body divider and the cap divider.

Since the components have rheology and viscosity characteristics that may greatly differ from one another, their natural tendency is to move through their respective chambers at different flow rates. However, the faster flowing component will not be able to more quickly fill its respective cap chamber because its flow in terms of volume/time will be determined by the aperture(s) in the face of the shoulder nozzle that correspond to its chamber; in the case of the faster flowing component, its flow in terms of volume/time will be slowed down by the aperture(s).

Similarly, the flow rate of the respectively slower flowing component into its cap chamber will be determined by the aperture(s) in the face of the shoulder nozzle that correspond to its chamber. Because the characteristics of the aperture(s), e.g., size, have been determined according the viscosity and rheology characteristics of this component, it must fill its cap chamber at a rate similar to that of the faster flowing component.

Once each component has filled its cap chamber, the components will be simultaneously dispensed from the dispensing orifice at a uniform rate, with an attractive appearance.

The embodiments represented by the previous examples have many advantages. For example, they provide there a multi-chambered dispensing tube that can consistently deliver the same amount, shape, and size of component compositions contained in each chamber simultaneously under the same dispensing rate. In particular, the container of the present invention is effective in providing uniform dispensing of components that have largely differing relative viscosity and rheology characteristics and need not be limited to components that are of similar viscosity and rheology characteristics. The container of the present invention is not limited to use with compositions that are formulated to be extrudable from the container at substantially equivalent compressive forces (i.e., compressive forces causing initiation of the components of the composition need not be be substantially equivalent). The preferred embodiments herein are also cost effective to manufacture.

As used herein the term "comprising" means that other steps and other ingredients that do not affect the end result can be added. This term encompasses the terms "consisting of" and "consisting essentially of".

It is understood that the examples and embodiments described herein are for illustrative purposes only and that various modifications or changes in light thereof will be suggested to one skilled in the art without departing from the scope of the present invention.

What is claimed is:

1. A multi-chambered tube for containing and dispensing a contents comprised of portions having differing rheology and viscosity characteristics, the tube comprising:

(a) a body divided by at least one body divider into at least two body chambers, each body chamber housing a portion of the contents, the body being sealed at one end by a crimp seal and one end of each body divider being sealed within the crimp seal, wherein the body divider is made from a substantially rigid material and is substantially non-displaceable in response to application of compressive force to the body; and (b) a shoulder comprised of a shoulder base and a shoulder nozzle, the shoulder base being attached to the body, the shoulder nozzle having a face provided with at least two apertures, at least one aperture in communication with each of the body chambers, and the other end of each body divider disposed within the shoulder and being sealed at the face of the shoulder nozzle; and (c) a cap comprised of a cap body provided with a dispensing orifice and at least one cap divider that separates the cap body into at least two cap chambers, each cap chamber being in communication with one of the body chambers via at least one of the apertures in the face of the shoulder nozzle; and wherein the cap chamber is a damper to regulate flow of the composition being dispensed; and (d) the shoulder nozzle being received within the cap body when the cap and the shoulder are assembled.

2. The tube of claim 1, wherein the compositions are physically separated by the body divider and the cap divider until the time of actual use.

3. The tube of claim 1, wherein the body divider has a thickness of from about 0.05 mm to about 0.3 mm.

4. The tube of claim 1, wherein the characteristics and number of the apertures in the shoulder nozzle face are determined based upon the viscosity and rheology characteristics of the portions of the contents.

5. The tube of claim 1, wherein the contents is a multi-phased dentifrice composition, each phase being housed in a separate body chamber.

6. The tube of claim 1, wherein the multi-chambered rube comprises two chambers.

7. The assembly of claim 1, wherein the shoulder nozzle face is provided with at least one groove into which a portion of each cap divider is received.

* * * * *